United States Patent [19]

Freeman

[11] 4,106,281

[45] Aug. 15, 1978

[54] TIME DISPLAYS FOR ELECTRONIC TIME KEEPING DEVICES

[76] Inventor: Alfred B. Freeman, 20418 Seaboard Rd., Malibu, Calif. 90265

[21] Appl. No.: 700,127

[22] Filed: Jun. 28, 1976

[51] Int. Cl.[2] ..... G04B 19/24

[52] U.S. Cl. ..... 58/50 R

[58] Field of Search ..... 58/23 R, 50 R, 127 R

[56] References Cited

U.S. PATENT DOCUMENTS

| | | | |
|---|---|---|---|
| 3,540,209 | 11/1970 | Zatsky et al. | 58/50 R |
| 3,596,462 | 8/1971 | Hayes | 58/50 R |
| 3,630,015 | 12/1971 | Lehovel | 58/50 R |
| 3,750,384 | 8/1973 | Miller et al. | 58/50 R |
| 3,757,511 | 9/1973 | Burgess et al. | 58/50 R |
| 3,823,549 | 7/1974 | Feldman | 58/50 R |
| 3,849,978 | 11/1974 | Davis | 58/50 R |
| 3,959,963 | 6/1976 | Murrell | 58/50 R |
| 4,007,583 | 2/1977 | Johnson | 58/50 R |

*Primary Examiner*—Robert K. Schaefer
*Assistant Examiner*—Vit W. Miska

[57] ABSTRACT

Optical displays for electronic watches or clocks use LED or LCD optical elements at the numbered positions on the watch or clock face to present time and other information from the electronic circuitry. Embodiments having 12 optical elements energize appropriate elements to show hour and 5 minute positions directly with time coding distinguishing between them. These embodiments also include apparatus to energize the optical elements in various time and space patterns to show the number of minutes the time is from the indicated five minute position. Another embodiment using six optical elements shows hour and 5 minute positions alternately by energizing two adjacent elements to indicate the intermediate positions. Still another embodiment uses four optical elements to show hour and 5 minute positions alternately with a special space and time code for other than quarterly positions, and further to show minute and second information on demand. The embodiment also includes controls to trigger animated display patterns for visual alarm or alert signaling.

13 Claims, 23 Drawing Figures

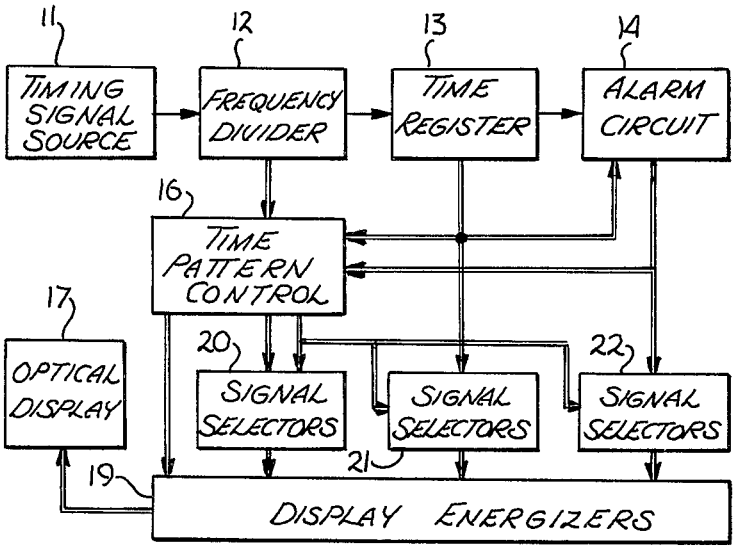
Fig. 1
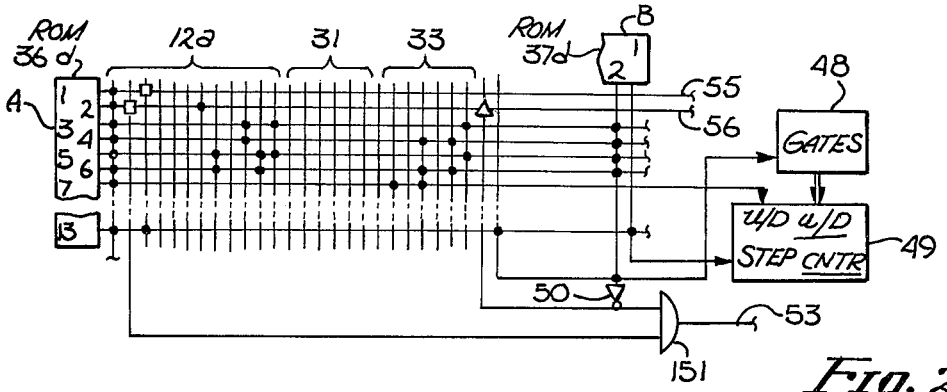
Fig. 2d
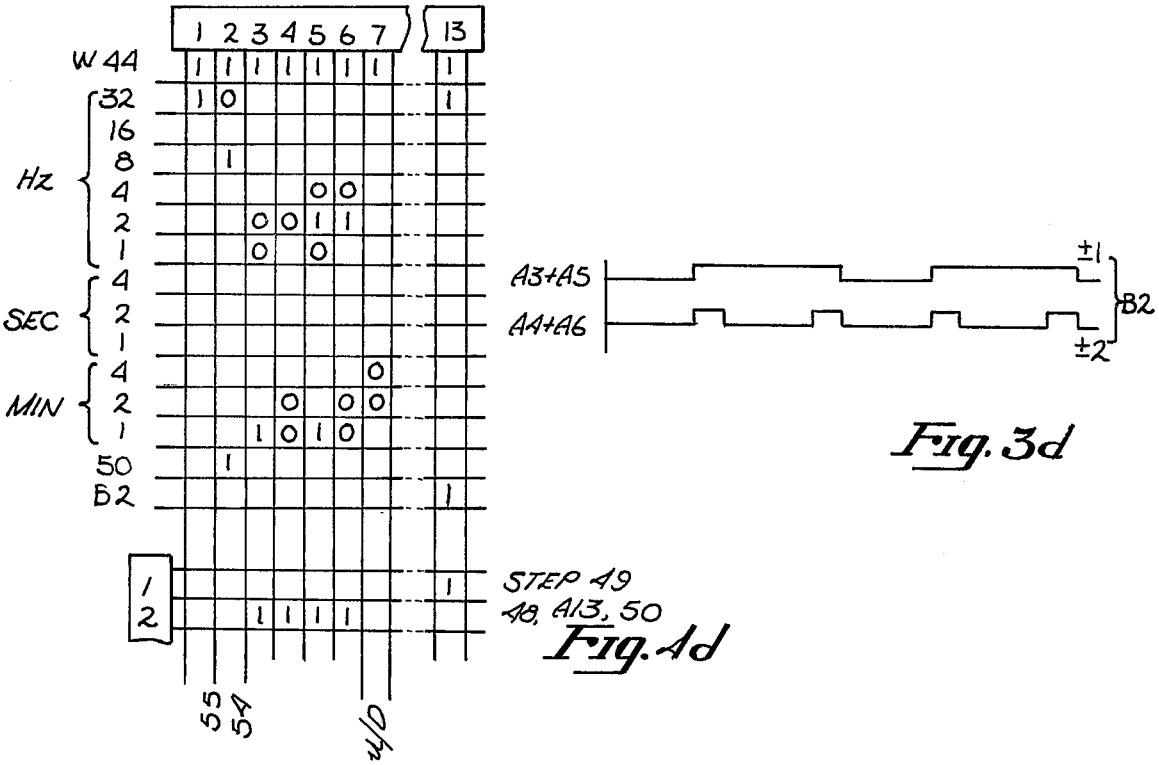
Fig. 3d
Fig. 4d

Fig. 3a
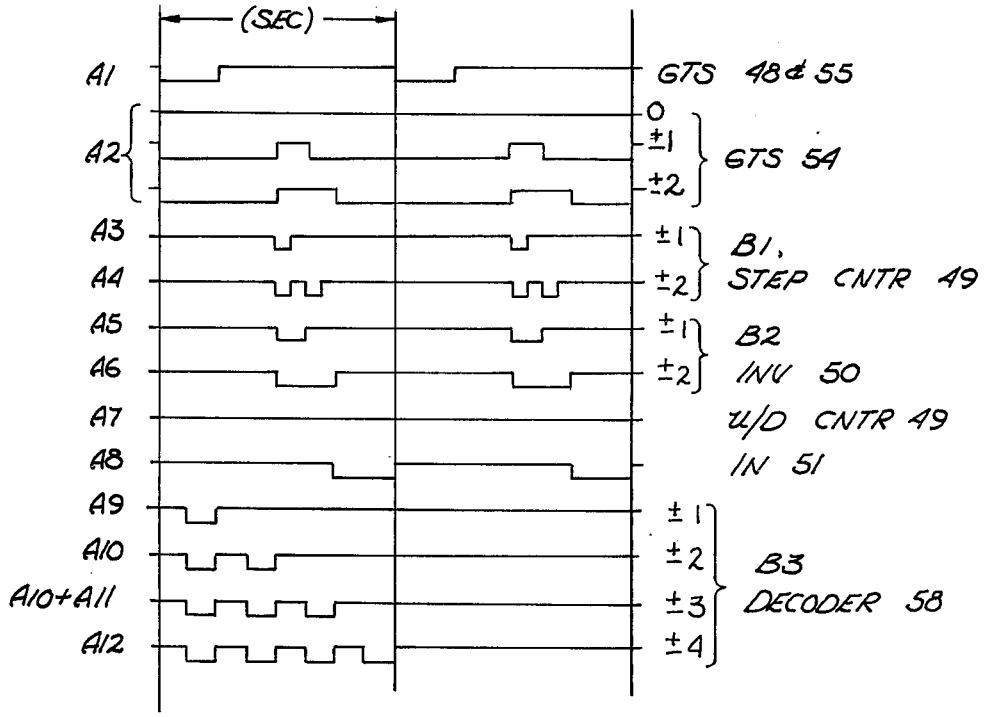
Fig. 3b
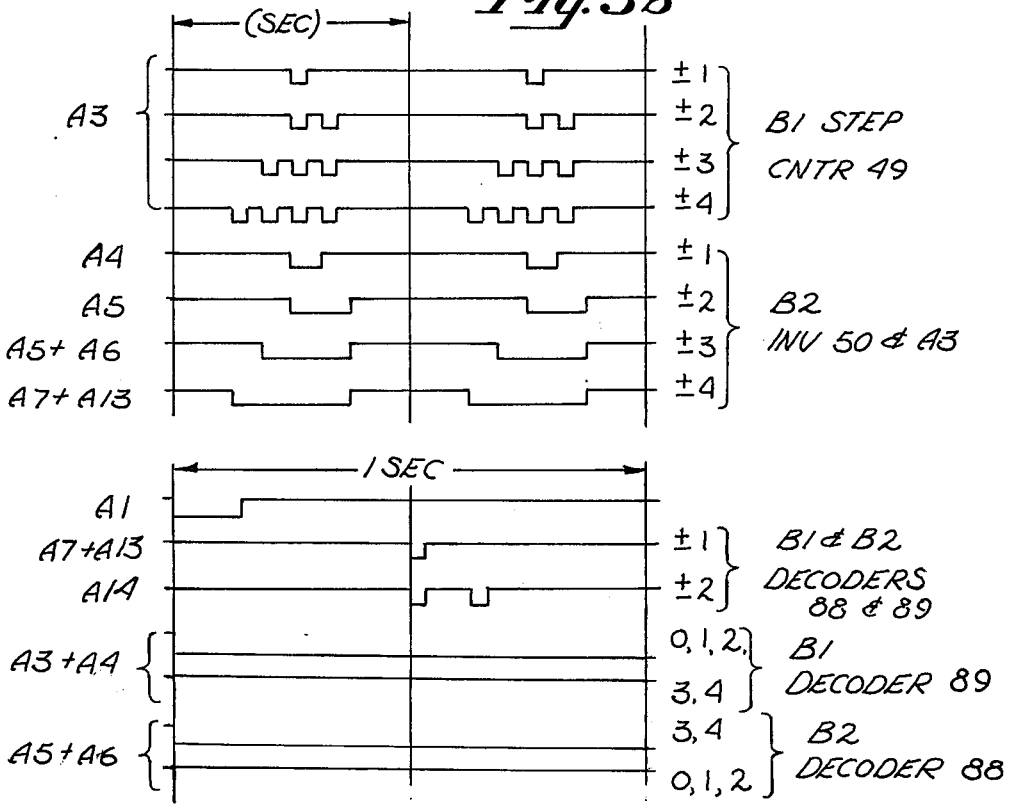
Fig. 3c

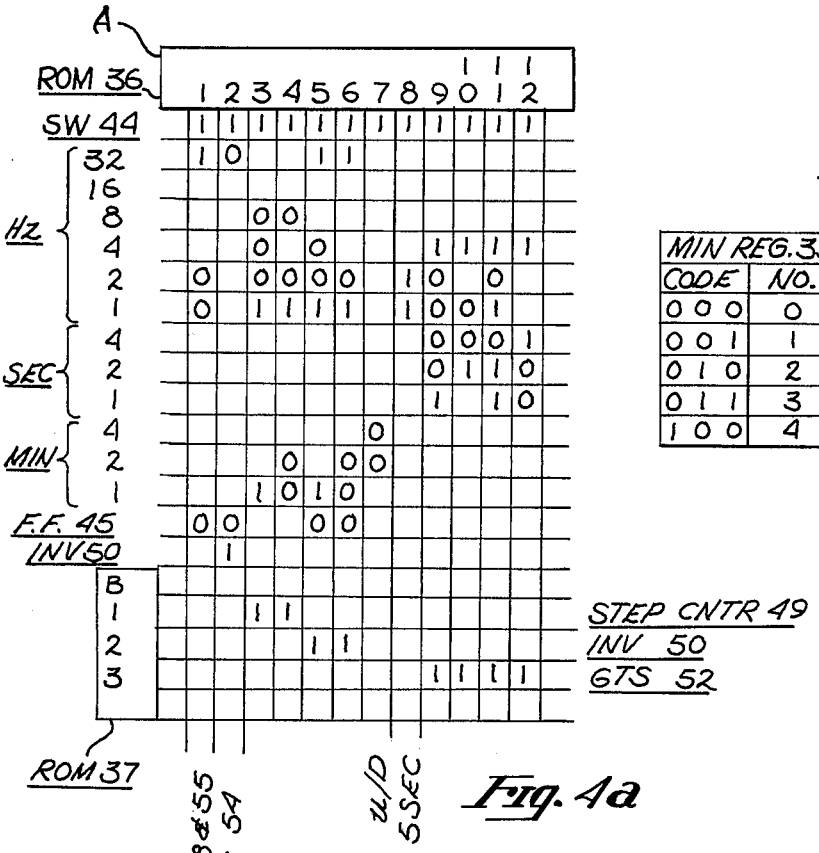
Fig. 4a
Fig. 5
| MIN REG. 33 | | FIG 2a | FIG 2b | FIG 2c |
|---|---|---|---|---|
| CODE | NO. | MIN | MIN | MIN |
| 0 0 0 | 0 | -2 | 0 | 0 |
| 0 0 1 | 1 | -1 | +1 | +1 |
| 0 1 0 | 2 | 0 | +2 | +2 |
| 0 1 1 | 3 | +1 | +3 | -2 |
| 1 0 0 | 4 | +2 | +4 | -1 |
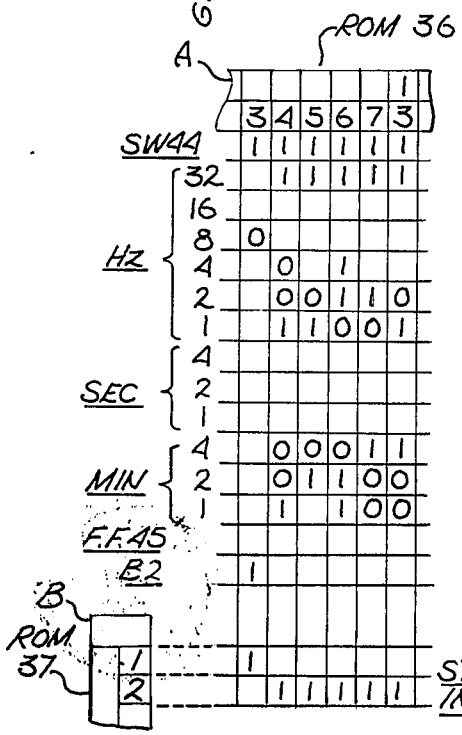
Fig. 4b
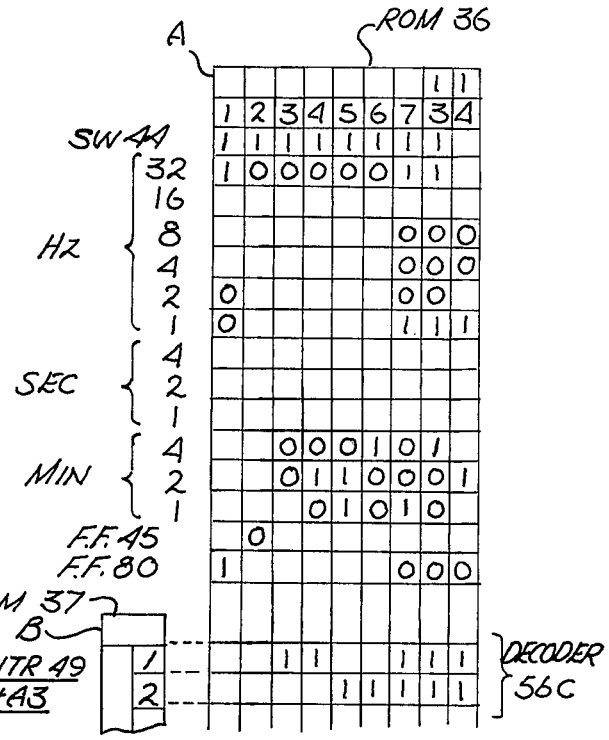
Fig. 4c TIME REGISTER
SEC
5 SEC
MIN
5 MIN
HOUR
GATES
1 OF 12 DECODERS
FREQ. DIV.
32 16 8 4 2 1
ROM 236
ROM 237
F.F.
H-SM
M-S
32 Hz
1 SEC
AC 7 UP
AC 7 DN
AC8
AC9
AC10
AC11
AC12
AC13

TIME DISPLAYS FOR ELECTRONIC TIME KEEPING DEVICES

BACKGROUND AND SUMMARY OF THE INVENTION

The instant invention is directed generally to optical readout displays for electronic watches or clocks, and specifically to displays having electrically energized optical elements located at the numbered, or hour, positions on the watch or clock face.

Most currently available electronic watches and clocks use decimal digit displays to show the time and other information. Decimal digit displays show the time accurately and make it easier for children to learn to tell the time. In addition to telling time, however, traditional watches also serve as items of personal adornment and manufacturers have devoted much effort to appearance and styling. Digital displays severly restrict the variations in style and appearance which are important for an item of jewelry. Another drawback of digital displays is the size required for the watches using them. Present watches are bulky for men and far too large to appeal to most women.

Several U.S. patents disclose other types of electrically energized optical displays to show the time for electronic watches. Toshio Kashio and Leo Wiesner show sets of electrically energized optical elements to present hour and minute hand positions in U.S. Pat. Nos. 3,844,105 and 3,908,355 respectively. U.S. Pat. Nos. 3,754,392; 3,919,935; and 3,922,847 to R. Gary Daniels, Toshio Kashio, and co-inventors Bobby Gene Culley and Engelbert Wolfgang Kehren respectively use two concentric rings of 12 and 60 optical elements to show hour and minute positions.

These displays use less power than decimal digit displays as only two elements need be energized to show the time. The large number of optical elements required, however, adds to the bulk and cost. If the optical elements are LCDs, the large number is especially disadvantageous since an equal number of connections must be made to the chip thus adding further to bulk and cost. The tightly packed ring of 60 optical elements also restricts the appearance and styling variations possible.

The instant invention provides time displays for electronic watches and clocks which use a much smaller number of optical display elements than prior art displays. The smaller number of elements opens up new styling possibilities and reduces size and cost for watches. The time and space code used to present the necessary information on the fewer elements also adds a visually pleasing animation. The new styling possibilities and the added animation will permit designers to make electronic watches more competitive in appearance and individuality with mechanical watches which have a long tradition as items of personal jewelry. The styling along with the smaller size will especially appeal to women and at least double the potential market for electronic watches. Animation further adds to the general appeal and lower cost is obviously important for the mass market.

The instant invention provides effective time displays with fewer optical display elements by combining conventional methods of time presentation with special time and space codes. When using 12 optical display elements located at the traditional numbered, or hour, positions on the watch or clock face, the invention shows the hour and 5 minute positions directly by energizing an element for each and distinguishing them by a time code. The time presentation is completed by further energizing the 12 elements in a combination time and space code to show the number of minutes from the 5 minute position. The invention further adds time or space coding for hour and 5 minute indications to display the time on less than 12 elements, such as six or four.

With 12 element displays, the 5 minute indication can be on steadily while the hour indication pulses alternately with the minute indications. The minute indications appear as animated arrows flashing from the 5 minute position in the intervals between hour pulses. The length of the arrow shows the number of minutes and the clockwise or counter clockwise direction shows before or after. Alternatively the minute indications can be limited to minutes after shown by clockwise movement. Or 5 minute and hour indications can remain on continuously with the 5 minute indication flickering to distinguish them. The minute indications then consist of apparent clockwise or counter clockwise rotations to show the minutes after or before respectively. The apparent rotations for minute indications stand out clearly from the hour and 5 minute indications.

The invention reduces the number of optical elements from 12 to six by alternating the hour and 5 minute indications and energizing two adjacent elements to indicate the intermediate positions. Minute indications accompany the 5 minute indications. The invention makes a further reduction to only four optical elements for the time display by again alternating the hour and 5 minute indications and using a time and space code for the positions adjacent to the quarterly positions. The quarterly positions are indicated individually by the four optical elements and the adjacent positions by flashing a one element arrow forward or back of the quarterly position. A demand switch obtains minute and second indications alternately in place of the hour and 5 minute indications. Each element can indicate the number of minutes past or apparent rotations can again indicate minutes before or after.

Various other types of time and space coding can be used for time presentations according to the invention. Information other than time information, such as alarm settings and calendar register days and months can also be shown in a similar way on the same displays. Seconds information can be shown in the same way as a minute information, on demand, or in a regular sequence. Seconds can also be shown along with hours and minutes by a combination of displays such as one having 12 elements for hours and minutes with one having four elements for 5 seconds or seconds. Finally, sequences such as repeated rotations or periodic flashing of all elements can serve as visual alarm or alert signals.

The time displays of the instant invention can use LEDs or LCDs as the optical elements in watches, and other types of optical elements in clocks and other suitable time keeping devices. It is expected that the displays will also be able to use other elements which may become practical in the future. As only two elements need be energized at a time, according to the invention the time displays use less power than decimal digit displays, making smaller batteries feasible for further reduction in the size of the watch. The power saving will be greater when LEDs are used. Since LCDs require connections from the chip to each element, reduction in the number of elements when LCDs are used is especially important for reduction in the cost of the watch.

While the previous discussion has been concerned with electronic watches, it will be recognized that the time displays of the instant invention can be used for electronic clocks. Relatively minor modifications to the circuitry of the invention adapt it for operation from a 60 hertz timing source, that is generally used for clocks in this country, or for operation from other frequency timing sources. Where power is not a problem, larger and brighter display elements may be used simply by providing drivers to handle the necessary level of power.

FIG. 1 is an overall block diagram showing the major components of the invention.

FIG. 2*a* is a partial block and partial array-logic schematic diagram of an embodiment of the invention.

FIGS. 2*b*, 2*c*, and 2*d* are array-logic schematic diagrams of modified sections of the ROMs of FIG. 2*a* which modify the embodiment of FIG. 2*a*.

FIGS. 3*a*, 3*b*, 3*c*, and 3*d* show the waveforms of signals occuring at various locations in the apparatus of FIGS. 2*a*, 2*b*, 2*c*, and 2*d* respectively.

FIGS. 4*a*, 4*b*, 4*c*, and 4*d* are charts showing the inputs and outputs for the gates of the ROMs of FIGS. 2*a*, 2*b*, 2*c*, and 2*d* respectively.

FIG. 5 is a chart showing the minute indications produced by the embodiments of FIGS. 2*a*, 2*b*, and 2*c* for each minute register position.

Figures 11A, 11B, 12:
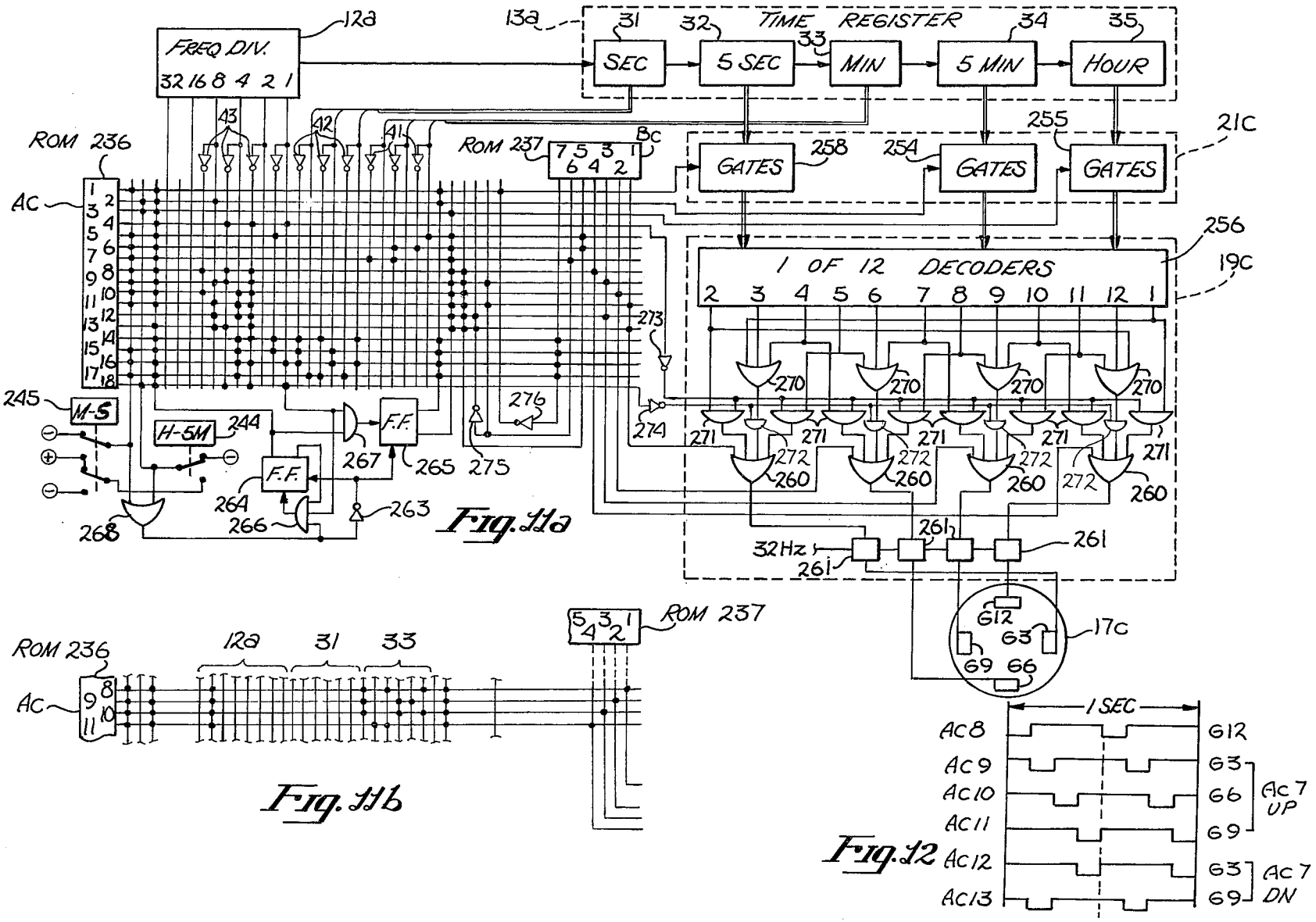

FIG. 11*a* is a partial block, partial array-logic schematic, and partial logic diagram of yet another embodiment of the invention.

FIG. 11*b* is an array-logic schematic diagram of modified sections of the ROMs of FIG. 11*b*.

FIG. 12 shows the waveforms of signals occuring at several locations in the apparatus of FIG. 11*a*.

Figures 2A, 2B, 2C:
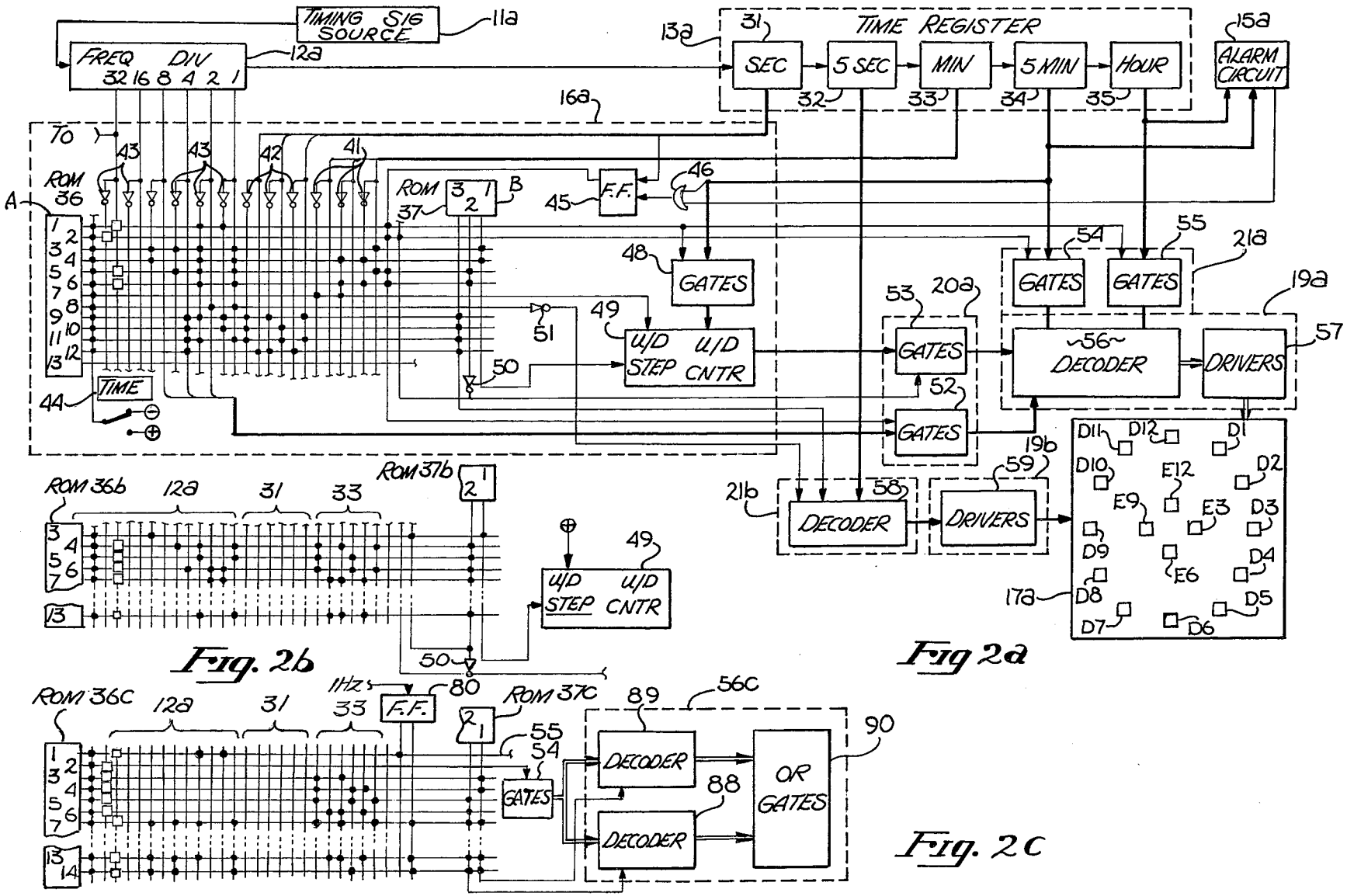
Figures 9, 10, 13:
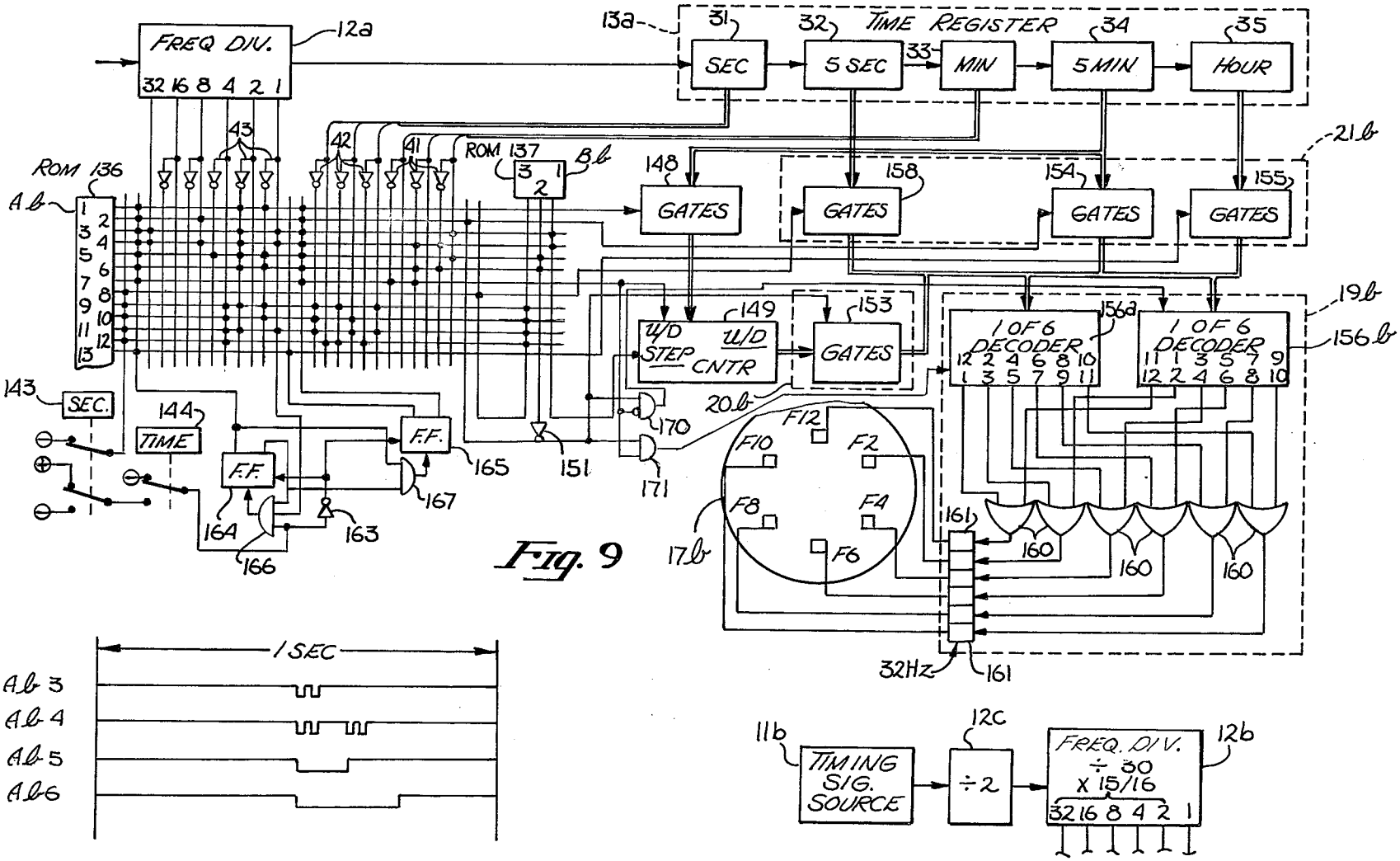
FIG. 9 is a partial block, partial array-logic schematic, and partial logic diagram of another embodiment of the invention.
FIG. 10 shows the waveforms of signals occuring at several locations in the apparatus of FIG. 9.

FIG. 13 is a block diagram of a modification to the frequency dividers of FIGS. 2*a*, 9, and 11*a*.

FIG. 1 shows a timing signal source 11, a frequency divider 12, a time register 13, and an alarm circuit 14 such as might be found in any electronic watch or clock. Stop watch and other apparatus sometimes associated with time keeping devices could be included as well. Time pattern control 16, the heart of the present invention, controls the application of information to optical display 17 via display energizers 19 by operating signal selectors 20, 21 or 22. Optical display 17 consists of LED, LCD, or other optical elements arranged in patterns to represent a number of watch or clock face positions. Display energizers 19 provide the necessary drive to activate the elements of optical display 17 in response to the signal inputs received. Time pattern control 16 controls display energizers 19 and parts of one or more of signal selectors 20, 21 or 22 to present sets of information in distinctive time patterns for recognition by the user.

Timing signal source 11 may be any source of signals suitable for time keeping purposes. Most electronic watches use quartz crystal oscillators or tuning fork oscillators to produce timing signals. Many electronic clocks in the U.S. use the 60 hertz power line as their timing signal source. Frequency divider 12 divides the frequency of the signal from timing signal source 11 to obtain a frequency suitable for driving time register 13. Most embodiments of time register 13 will require a 1 hertz input. Depending on the frequency from timing signal source 11, frequency divider 12 may divide by a factor ranging from 60 to several thousand hertz.

Time register 13 holds the number of seconds, minutes, and hours in electrical form and provides an output to drive alarm circuit 14. Alarm circuit 14 may include an alarm register to hold hour and minute information in electrical form, means to compare time and alarm settings, and means to set the alarm register. Alarm circuit 14 may produce outputs for the alarm register setting and for an alarm trigger when time and alarm settings are the same.

The user may select time register 13 or alarm circuit 14 as the source of information to be presented on optical display 17. Time pattern control 16 then uses signals from frequency divider 12 and time register 13 to develop control signals to present different sets of information in distinctive time patterns. Time pattern control 16 applies the signals developed to display energizers 19 and signal selectors 20 and to the one of signal selectors 21 or 22 associated with the selected source. The time patterns enable the user to distinguish the information presented on optical display 17.

Signal selectors 20, 21, and 22 may consist simply of sets of gates which control the passage of sets of information to display energizers 19. They may also consist of binary or other types of decoders which are responsive to control inputs for passing information. Still further, signal selectors 20, 21, and 22 may consist of combinations of gates and decoders. Display energizers 19 will include driver circuits to properly energize the elements of optical display 17 in response to the input signals received. Display energizers 19 will also include binary or other decoders if they are necessary and not already included as part of signal selectors 20, 21, and 22. Binary or other decoders may not be necessary if shift counters are used in time register 13.

The main purpose of the apparatus of FIG. 2*a* is to present the hours, minutes, and seconds of the time in an easy to understand manner. A secondary purpose is to produce an animated time display which is eye catching and attractive. The apparatus also produces a special optical signal to alert the user when an alarm setting or preselected time has been reached. The presentations are made on optical display 17*a* which has optical elements D1 through 12 located at the one through 12 o'clock positions respectively and optical elements E3, 6, 9, and 12 located around a small inner circle at 3, 6, 9, and 12 o'clock positions respectively. Either LEDs, energized on demand, or LCDs, energized continuously, can be used for elements D1 through 12 and E3, 6, 9, and 12.

The apparatus energizes the appropriate ones of elements D1 through 12 to present the hours and minutes. One is energized steadily to indicate the 5 minute position while another is pulsed on periodically to indicate the hour position in a manner insuring that the two indications will not be confused. The minutes before or after the indicated five minute position are shown by applying very short pulses to the appropriate number of elements immediately preceding or following the five minute indicating element. The short pulses occur between the hour pulses so they won't be masked if the hour indication is on the same element. If the time is 12:17, for example, element D12 will be pulsing on and off periodically to indicate the hour position and elements D4 and D5 will be pulsing on briefly in between the hour pulses to indicate 2 minutes past the 15 indicated by the 5 minute position.

The apparatus energizes one or two of elements E3, 6, 9, and 12 to show the seconds. The 15, 30, 45, and 60 (or 0) second positions are shown simply by energizing the appropriate one of elements E3, 6, 9, or 12. The second positions following or preceding these positions are indicated by continuously energizing the element closest to the position and then pulsing the element following or preceding respectively. The continuously energized element is then blinked the number of times each second corresponding to the number of seconds past the indicated 5 second position. Starting with 35 seconds, for example, element E6 will be on steadily and element E9 will be pulsed during the first second. This will be repeated during the next second except that element E6 will blink once. Element E6 will blink two, three, and four times during the second, third, and fourth seconds respectively. The following second is the 40th second. Element E9 then comes on steadily and element E6 pulses during the next second. Element E9 then blinks the appropriate number of times on successive seconds while element E6 flashes on once each second. The seconds display is thus a dynamic and rapidly changing one which supplements the animation of the hours and minutes display.

The apparatus produces the special optical signal to alert the user when the time reaches a preselected interval, such as every hour, or when it reaches the alarm setting. Elements D1 through 12 are energized one after the other in turn several times to produce an eye-catching rotating effect. It is assumed that the user will be awake, with the time keeping device within his peripheral vision.

Timing signal source 11*a* and frequency divider 12*a* are specific embodiments of time signal source 11 and frequency divider 12 of FIG. 1 previously described. Timing signal source 11*a* is a quartz crystal oscillator and frequency divider 12*a* is a binary counter whose last six stages produce outputs of 1, 2, 4, 8, 16, and 32 hertz. Time register 13*a* consists of second register 31, five second register 32, minute register 33, five minute register 34, and hour register 35. Time register 13*a* differs from time registers usually found in electronic watches only in that is has 5 second and 5 minute registers 32 and 34 rather than 10 second and 10 minute registers. Second and minute registers 31 and 33 divide by 5 while 5 second, 5 minute, and hour registers 32, 34, and 35 divide by 12.

The stages of registers 31, 32, 33, 34, and 35 all step when the output of the previous stage goes negative. The major component of time pattern control 16 is a programmed logic array, or PLA, consisting of the combination of ROM 36 and ROM 37. ROMs 36 and 37 are read only memories with details shown by array-logic schematics. The array-logic schematics consist simply of input lines and perpendicular output lines together with dots at line intersections to show input connections to outputs. Each output line represents a gate receiving inputs from those input lines whose intersections with the output line are marked with a dot. The output lines of ROMS 36 and 37 go negative when all of their inputs are positive and go positive when any input is negative. The output lines extend from boxes enclosing their identifying numbers. The numbers for the output lines of ROM 36 are preceded by the letter A and those for ROM 37 by the letter B.

The use of PLAs and ROMs to perform logic functions is described in the book, "MOS/LSI Design and Application" by Dr. William N. Carr and Dr. Jack R. Mize, published by McGraw-Hill Book Company. The book also describes and uses array-logic schematics. The array-logic schematics not only show the input-output relations in a very concise way but also resemble the actual circuit layout on chip. A single mask in the chip fabrication process determines the input-to-output connections and so the input-output relations for the logic to be performed. Different sets of logic functions for different models can be programmed simply by substituting a mask for making different interconnections. FIGS. 2*b* and 2*c l show variations which can be made in this manner to obtain variations in performance, as will be described later.*

ROM 36 receives inputs directly and through inverters 41 from minute register 33, directly and through inverters 42 from second register 31, and directly and through inverters 43 from the last six stages of frequency divider 12*a*. ROM 36 further receives an input from time switch 44 and an input from flip flop 45. ROM 37 receives all of its inputs from some of the outputs of ROM 36. The remaining outputs of ROM 36 and the outputs of ROM 37 go to signal selectors 20*a*, and 20*b*, and 21*a* and to gates 48 and up/down counter 49 which are part of time pattern control 16*a*. The relation between the inputs and outputs of ROMs 36 and 37 and their interactions with other components will be described next.

Time switch 44 must be placed in the position other than that shown to obtain a display of the time on optical display 17*a*. Switch 44 may be one which is operated by the user each time he wants a time readout, or one which remains on for a continuous time display. The first type is necessary when LEDs are used for the elements of optical display 17 and the second when LCDs are used. Switch 44 could, of course, be replaced by a fixed connection when LCDs are used and are to be left on continuously. As shown by the dots at the intersections, the input line from the arm of switch 44 connects to all outputs of ROM 36. In the position shown, switch 44 holds this input line negative which in turn holds the outputs positive. In its other position, switch 44 applies a positive potential to the line which allows the outputs to be positive or negative depending upon their other inputs.

In addition to the input from switch 44, the A1 output of ROM 36 receives an input from flip flop 45, a 32 hertz input from frequency divider 12*a* and 1 and 2 hertz inputs from frequency divider 12*a* through inverters 43. The 32 hertz input is shown by a square dot, rather than a round one, and will be taken to indicate that it will be present when the elements of display 17*a* are LEDs and absent when the elements are LCDs. The 32 hertz input, when present, allows for multiplex use of some circuits of display energizers 19*a*, as will later be explained. The upper row of FIG. 3*a* shows that the A1 output waveform without the 32 hertz component is a $\frac{1}{2}$ second negative pulse occurring every second. If the 32 hertz input is present, the A1 output is a train of 32 hertz signal bursts with envelopes represented by the negative pulses shown in FIG. 3*a*.

The negative pulses or 32 hertz bursts result when flip flop 45 is reset and the inverted 1 and 2 hertz inputs are both positive, a condition which exists for ¼ second every second. Flip flop 45 will be in the reset condition except for brief intervals during which alert signals are to be produced, as will later be explained. When set, flip flop 45 inhibits the output of A1, holding it positive. The A1 output goes to operate gates 55 in signal selectors 21*a* and to operate gates 48 in time pattern control 16*a*. When gates 55 are operated, the one of elements D1 through 12 corresponding to the contents of hour register 35 is energized, as will later be explained. The A1 output thus causes the element corresponding to the hour position to energize ¼ second every second while switch 44 is in its other position and flip flop 45 is reset. Operation of gates 48 sets counter 49 to the number held in 5 minute register 34 for a purpose which will be explained later.

FIG. 4*a* is a logic chart which shows the same information as that shown by the array-logic schematics of ROMs 36 and 37 in FIG. 2*a*, but in a different way. FIG. 4*a* uses a single row for each input signal by replacing the dots indicating connections with "1"s or "0"s. The "1"s indicate when a periodic signal is directly applied; when a logic output is True; and when a binary digit is a "1." The "0"s indicate an inverted periodic signal, when a logic output is False, or when a binary digit is a "0." All inputs to an output of ROM 36 must meet the indicated conditions to produce a negative output which is considered as a True or "1" input to ROM 37. An output of ROM 37 will go positive when any of its inputs are negative. AND combinations of "1" and "0" input conditions to produce ROM 36 outputs, and OR combinations to produce ROM 37 outputs, can thus be read directly from FIG. 4*a*. The information in this form may be easier for many to read and is presented for the reader's convenience.

FIGS. 2*a*, 3*a*, and 4*a* may be referred to in combination to facilitate an understanding of the functioning of ROMs 36 and 37. The A1 output has been previously discussed. The A2 output of ROM 36 receives inputs from switch 44, from the 32 hertz output of frequency divider 12*a* through an inverter 43, from inverter 50, and from flip flop 45. The inverted 32 hertz input connection is shown on FIG. 2*a* as a square dot to indicate, as for the A1 output, that it will be made only when elements D1 through 12 are LEDs. The A2 output waveform when the input conditions are met is either a 32 hertz signal, or a negative level, as shown on the second row of FIG. 3*a*. The A2 output goes to operate gates 54 of signal selectors 21*a* either continuously or at a 32 hertz rate, depending on whether the inverted 32 hertz signal is applied. The result in either case is to energize the one of elements D1 through 12 representing the 5 minute position held by 5 minute register 34 in a continuous or apparently continuous manner, as will later be explained.

Outputs A3 through 7 of ROM 36 are used to produce indications of the minutes by which the time differs from the 5 minute position held by 5 minute register 34. The first and second columns of FIG. 5 show the binary code and decimal numbers for each of the 5 positions of minute register 33. Each time it returns to its 0 position, minute register 33 steps 5 minute register 34 to its next position. As shown in the third column of FIG. 5, for the FIG. 2*a* apparatus, register 33 is set so the time is 2 minutes before the 5 minute position when it reaches the 0 position and steps register 34. As also shown in the third column of FIG. 5, the time will be 1 minute before, right on, 1 minute after, and 2 minutes after when register 33 holds the numbers 1, 2, 3, and 4 respectively.

The A3 output will be a 1/16th of a second negative pulse when the number held in register 33 is a 1 or a 3, as it will be when the time is 1 minute before or 1 minute after the five minute position. The A4 output will be two successive 1/16ths of a second negative pulses when the number in register 33 is a 0 or a 4, as it will be for 2 minutes before or 2 minutes after. The A3 and A4 outputs are both applied as inputs to the B1 output of ROM 37. The B1 output goes to the step input of up/-down counter 49. The negative going pulses from A3 and A4, which are shown in FIG. 3*a*, are inverted to positive pulses in the B1 output. Counter 49, unlike the registers, steps on positive going edges and so steps on the leading positive edges of the B1 output. Counter 49 will thus be stepped once by the B1 output each second when the time is 1 minute before or after the 5 minute position in register 34, and twice when the time is 2 minutes before or after.

The A5 output produces a ⅛th of a second negative pulse starting with the leading edge of the A3 output whenever the time is 1 minute before or after. The A6 output produces a ¼ second negative pulse starting with the leading edge of the first pulse from the A4 output whenever the time is 2 minutes before or after. The A5 and A6 outputs, which occur whenever the A3 and A4 outputs respectively occur, and applied as inputs for the B2 output of ROM 37. The B2 output goes through inverter 50 to operate gates 53 of signal selector 20*a* during the negative pulse times of the A5 and A6 outputs shown in FIG. 3*a*. Operation of gates 53 applies the contents of counter 49 to display energizers 19*a* to energize corresponding ones of elements D1 through 12, as will later be explained. The A7 output is applied to the up/down control input of up/down counter 49 and will be negative when minute register 33 holds a 0 or a 1, as will be the case when the time is before the 5 minute position in register 34. Counter 49 will count down when its up/down control input is negative and will count up when it is positive.

It will be recalled that the A1 output operates gates 48 to set counter 49 to the number in 5 minute register 34 every second. The B2 output steps counter 49 once or twice when the time is 1 or 2 minutes respectively before or after the 5 minute position in register 34. The A7 output controls counter 49 to step down or up when the time is before or after respectively the 5 minute position. The B2 output operates gates 53 to apply the number in counter 49 after each step to display energizer 19*a* for ⅛th of a second each second. The result is that those elements D1 through 12 before or after the element representing the 5 minute position in register 34 are energized to indicate the minutes by which the time is before or after the 5 minute position.

If the time is 1 minute before or after the 5 minute position, for example, counter 49 will be stepped once backward or forward respectively from the number in register 34. Operation of gates 53 then results in the elements before or after the 5 minute position respectively being energized for ⅛th second every second. When the time is 2 minutes before or after, counter 49 will be stepped twice backward or forward from the 5 minute position respectively each second. The two elements forward or back respectively from the 5 minute position will then be energized in turn for ⅛th of a second each. This energizing of elements as a result of the B1, B2, and A7 outputs occurs between the times when the element indicating the hour position is energized, thus ensuring that the minute indications will not be masked when the hour position is adjacent to the five minute position.

An inspection of FIGS. 2*a* and 4*a* shows that the outputs from minute register 33 to ROM 36 enable outputs A3 and A5 for numbers 1 and 3, outputs A4 and A6 for numbers 0 and 4, and outputs A7 for numbers 0 and 1. The respective binary digit input combinations are those common to the respective pairs of numbers. The 1 hertz and inverted 2, 4, and 8 hertz input combinations to A3, A4, and A6 outputs produce the waveforms shown in FIG. 3*a* when the respective outputs are enabled by the proper input combinations from register 33. FIG. 2*a* also shows square connections for the 32 hertz input to the A5 and A6 outputs, again indicating that the connections are present only for use with LEDs. The waveforms for the A5 and A6 outputs are then only the envelopes of 32 hertz bursts.

Gates 52 supply the remaining sets of inputs to display energizer 19*a* when a trigger from OR gate 46 sets flip flop 45. Alarm circuit 15 produces a trigger signal to gate 46 when the time reaches the alarm setting. Triggers may also be obtained from 5 minute register 34 at preselected times such as the start of every hour. Second register 31 provides an input to reset flip flop 45 and terminate the operation of gates 52 after a trigger. As second register 31 produces an output trigger when it reaches the number 0, all time changes will occur when it is at that setting. An appropriate output of register 31 will thus reset flip flop 45 a preselected number of seconds after it has been set.

When flip flop 45 is in the set condition, it applies a negative input to ROM 36 and to gates 52. The negative input to ROM 36 goes to gates A1, A2, A5, and A6 and inhibits their outputs so that gates 53, 54, and 55 will not be operated while flip flop 45 is set. Gates 52 operate to pass the 1, 2, 4, and 8 hertz outputs from frequency divider 12*a* to display energizers 19*a*. The 1, 2, 4, and 8 hertz input combination cycles through the binary code combinations for the numbers 0 through 15 once each second. Display energizers 19*a* respond to the code combinations for the numbers 1 through 12 and so energizes elements D1 through 12 once each second as the input passes through the numbers 1 through 12 while flip flop 45 is set. The successive energizing of elements D1 through 12 gives a rotating effect which, when within the user's field of vision, functions as an alert.

The type of apparatus most suitable for decoder 56 and drivers 57 of display energizers 19*a* depends on whether elements D1 through 12 are LEDs or LCDs, and on the way in which the numbers 1 through 12 are presented by registers 34 and 35 and counter 49. For LEDs and straight binary representations, decoder 56 will be a 1 of 12 decoder and drivers 57 will be 12 drivers, each receiving one of the outputs of decoder 56 and applying its output to one of elements D1 through 12. The 32 hertz input to the A1, A5, and A6 outputs and the inverted 32 hertz input to the A2 output insure that gates 54 will be operated over a different part of the 32 hertz cycle than gates 53 and 55. Only one set of data will thus be applied to decoder 56 at a time, since gates 53 and 55 never operate at the same time, and gates 52 operate only when the others are inhibited.

Figure 6:
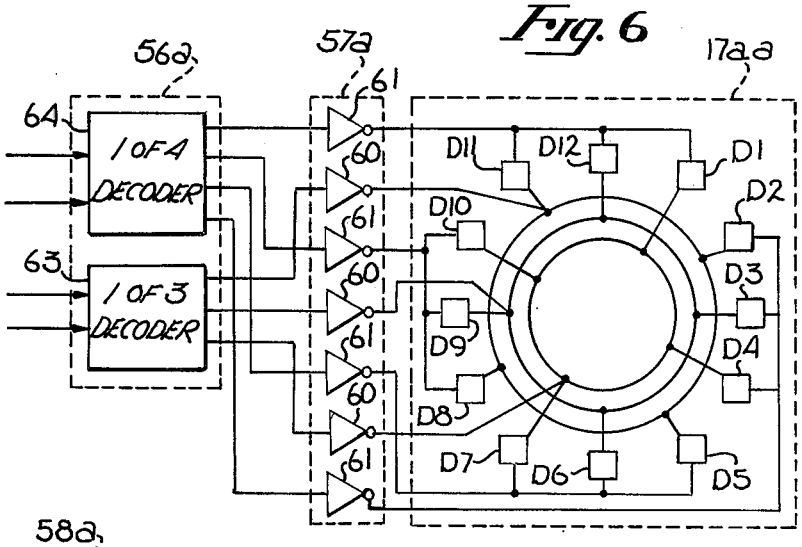
FIG. 6 is a block diagram of an embodiment of some of the decoders and drivers of FIG. 2*a*.

While the aforegoing apparatus requires 12 drivers for driver 57, it is possible, by using an arrangement such as that of FIG. 6, to get by with only seven. Elements D1 through 12 are connected as shown in FIG. 6. Terminals for one polarity input are connected together in groups of three and the other polarity terminals are connected together in groups of four. Drivers 57*a* consists of three amplifiers 60 producing one polarity output and four amplifiers 61 producing the opposite polarity output. The outputs of amplifiers 60 connect to the three groups of four and the outputs of amplifiers 61 connect to the four groups of three. One of elements D1 through 12 will be energized when its unique combination of one of amplifiers 60 and one of amplifiers 61 is turned on.

Figure 7:
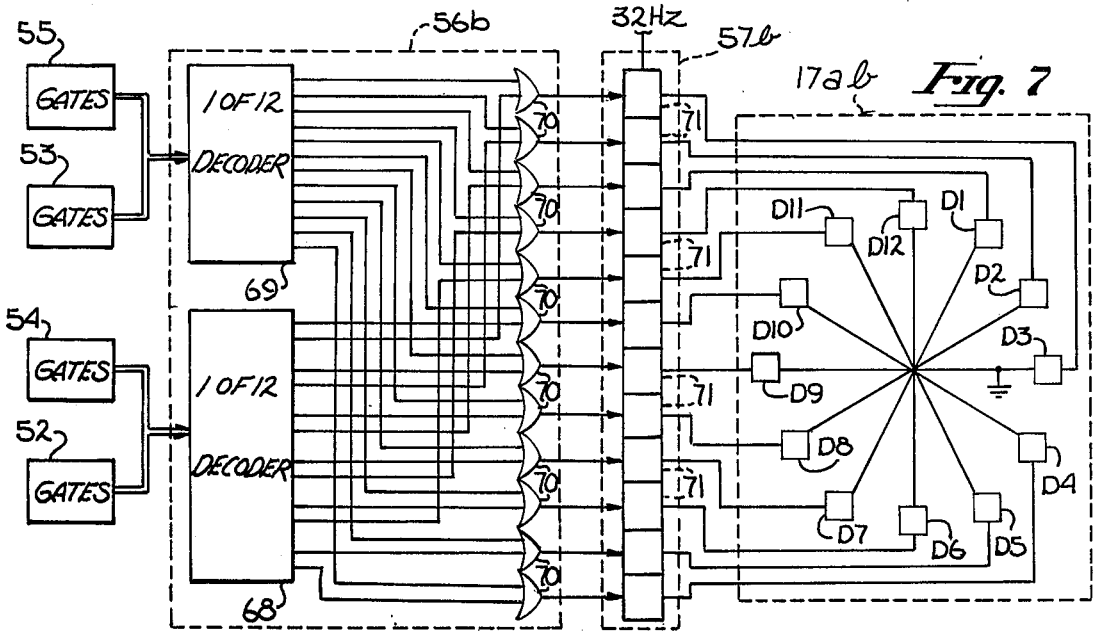
FIG. 7 is a partial block and partial logic diagram of some of the decoders and drivers of FIG. 2*a*.

Decoder 56*a* consists of a 1 of three decoder 63 and a 1 of four decoder 64 providing inputs for amplifiers 60 and 61 respectively. Decoder 63 responds only to 1, 2, and 3 and not to 0; thus there is no response unless one of gates 52, 53, 54, or 55 is operated. Registers 34 and 35 and counter 49 will use divide by 3 and divide by 4 circuits to accomplish the necessary divide by 12 and provide the appropriate inputs to decoder 56*a*. If registers 34 and 35 and counter 49 further use shift counters having a different output for each number for the divide by 3 and divide by 4 functions, decoders 63 and 64 could be dispensed with and the inputs to amplifiers 60 and 61 taken directly from gates 52, 53, 54, and 55.

Where elements D1 through 12 are LCDs, the 32 hertz and 32 hertz inverted inputs to ROM 36 are not used. This means that gates 54 and 55 will then be operated at the same time, and since the presentation of two sets of data at the same time will produce errors, a single 1 or 12 decoder 56 will not suffice. The apparatus of FIG. 7 includes two 1 of 12 decoders 68 and 69 in decoder 56*b* to handle two sets of data simultaneously. Gates 52 and 54, which are never operated at the same time, have outputs going to decoder 68. Gates 53 and 55, which are also never operated at the same time, have inputs going to decoder 69.

Decoder 56*b* further includes 12 OR gates 70 which combine the respective outputs of decoders 68 and 69 and apply them to drivers 57*b*. Drivers 57*b* consist of 12 drivers 71 having outputs connected to elements D1 through 12 as shown. Drivers 71 will be transmission gates controlling the application of a 32 hertz or other a-c signal to elements D1 through 12 when these elements are LCDs. For use with the apparatus of FIG. 2*c*, to be later described, drivers 71 will be transmission gates for use with LCDs and will be conventional LED drivers for use with LEDs.

Returning now to FIG. 2*a*, outputs A8 through 12 of ROM 36 control the production of the seconds display on elements E3, 6, 9, and 12. Elements E3, 6, 9, and 12 are driven by drivers 59 which receive inputs from decoder 58 of signal selectors 21*b*. Decoder 58 receives the output of 5 second register 32 directly and also receives two control inputs, one from the A8 output through inverter 51 and the other directly from the B3 output of ROM 37. An embodiment for decoder 58 and drivers 59 is shown in FIG. 8, and will be described later.

It will be recalled that the 5 second positions are to be shown on elements E3, 6, 9, and 12 by steadily energizing the element closest to the position and briefly energizing an adjacent element when the actual position is not right on that indicated by the steadily energized one. The element flashed by being briefly energized indicates that the position is one before or one after, depending on its relative location to the steadily energized one. The A8 output through inverter 51 to decoder 58 enables the flashing when it goes negative, as shown in FIG. 3*a*, for ¼ second at the end of each second. The ¼ second negative outputs are the result of the 1 and 2 hertz signals applied directly as inputs to the A8 output.

It will further be recalled that the number of seconds from the indicated 5 second position were also to be shown by blinking the steadily energized element an appropriate number of times to indicate the number of seconds past. Outputs A9 through 12 produce 1 through 4 negative pulses per second, as shown in FIG. 3*a*, when the numbers in second register 31 are 1 through 4 respectively. The B3 output receives the A9 through 12 outputs as its inputs and disables decoder 58 for intervals corresponding to the intervals of the negative pulses shown in FIG. 3*a*.

Figure 8:
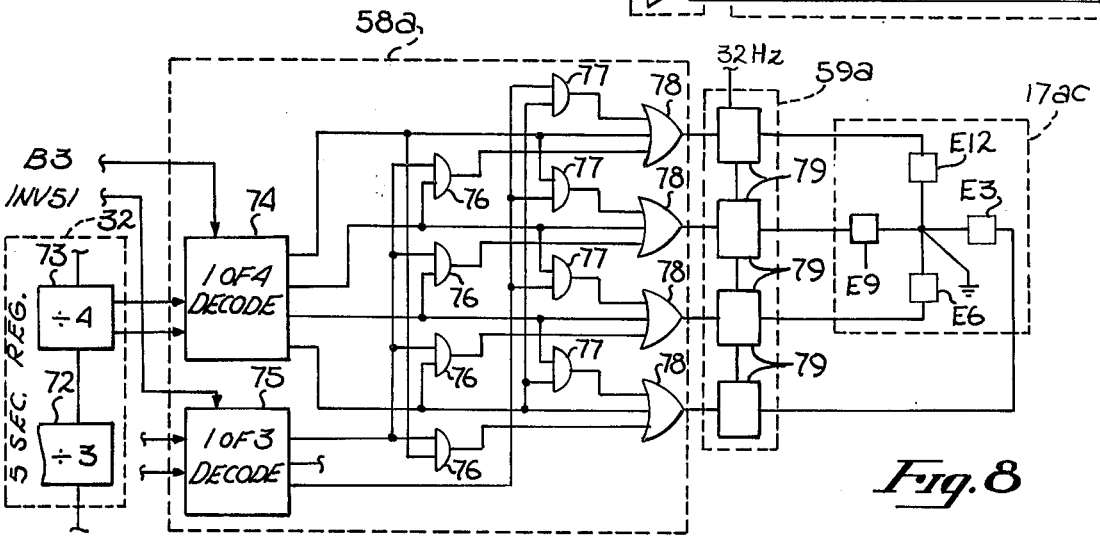
FIG. 8 is a partial block and partial logic diagram of an embodiment of other decoders and drivers of FIG. 2*a*.

As shown in FIG. 8, decoder 58*a* consists of a 1 of 4 decoder 74, a 1 of 3 decoder 75, four AND gates 76, four AND gates 77, and four OR gates 78. Seconds register 32 consists of the cascaded combination of a divide by 3 circuit 72 and a divide by 4 circuit 73 providing inputs to decoder 75 and decoder 74 respectively. The divide by 4 circuit 73 holds numbers corresponding to the quarterly positions, and divide by 3 circuit 72 holds numbers corresponding to the positions before, right on, and after the quarterly positions. The outputs from decoder 74 thus correspond to the four quarterly positions and the outputs from decoder 75 to the before and after positions. The right on output from decoder 75 is not used.

Each of the outputs of decoder 74 is applied to one of gates 76, 77, and 78. The outputs applied to OR gates 78 go on to corresponding drivers 79 of drivers 59*a* to energize corresponding ones of elements E3, 6, 9, and 12. These outputs produce the steadily energized one of elements E3, 6, 9, or 12 showing the nearest quarterly position. The B3 output applied to decoder 74 disables it the number of times a second corresponding to the number of seconds past the 5 second position as previously described.

Each OR gate 78 also receives inputs from one of AND gates 76 and one of AND gates 77. The before output of decoder 75 enables AND gates 77 and the after output enables AND gates 76. The output from inverter 51 enables the production of the before and after outputs of decoder 75 only during the last ¼ of each second. When the number in 5 second register 32 is for one before the quarterly position, AND gates 77 then pass pulses to energize the one of elements E3, 6, 9, or 12 before the one indicating the quarterly position for ¼ each second. AND gates 76 similarly pass pulses to energize the element after the quarterly position when register 32 holds the number for the five second position following the quarterly position. Drivers 79, like drivers 71, of FIG. 7, will be transmission gates when elements E3, 6, 9, and 12 are LCDs and will be conventional LED drivers when they are LEDs.

FIG. 2*b* shows modifications to ROMs 36 and 37 to produce indications of only the numbers of minutes past the 5 minute position rather than the numbers both before and after the 5 minute position. While up to 4 minutes past must be shown as opposed to up to two before or after, only past makes for an easier conversion to telling the time in numbers and may be preferred by many users. For the past only system, the time will be set so that minute register 33 reaches the number 0 and triggers 5 minute register 34 right on the start of the 5 minute interval. The numbers in register 33 will then correspond to the number of minutes past the five minute position as shown in the fourth column of FIG. 5.

Outputs A4 through 7 and A13 of ROM 36 go as inputs to output B2 of ROM 37. FIG. 3*b* shows the waveforms produced by A4 through 7 and A13 for the different numbers of minutes past as indicated by the number in register 33. Outputs A4 and A5 produce waveforms for the 1 and 2 minutes past respectively. Outputs A5 and A6 in combination produce a waveform for 3 minutes past and outputs A7 and A13 in combination produce a waveform for 4 minutes past. The B2 output is applied through inverter 50 to operate gates 53 and directly as an input to ROM 36 for the A3 output.

The A3 output goes as an input to the B1 output of ROM 37. An inverted 8 hertz signal also goes to output A3 which is enabled during the intervals of negative pulse outputs from outputs A4 through 7 and A13. The A3 output thus has waveforms as shown in FIG. 3*b* consisting of a number of cycles of the 8 hertz signal corresponding to the number of minutes past. The B1 output goes, as before, to the step input of counter 49 to step it the number of times corresponding to the number of minutes past. The up/down control of counter 49 is connected to a positive potential so it always counts up. It will be recalled that counter 49 is set to the number in 5 minute register 34 at the start of each second. Operation of gates 53 thus applies numbers for elements past that indicating the five minute position to successively energize the number of elements past, corresponding to the number of minutes past the 5 minute position.

The second modification to the same sections of ROMs 36 and 37 shown in FIG. 2*c* serves to indicate the minutes from the 5 minute position in still another way. In this modification, the element immediately preceding or following the one indicating the 5 minute position flashes once or twice to show one or 2 minutes before or after the 5-minute reading respectively. This modification does not use counter 49 and its associated gates 48 and 53 but adds flip flop 80 to stretch out the time scale and also shortens the flashes over those previously used. These latter changes make for easier discrimination between hour and minute indications when the hour indication is adjacent to the 5 minute indication. Those skilled in the art will recognize that similar time scale and timing changes may also be made to the embodiments of FIGS. 2*a* and 2*b* for the same reason.

For this modification, the time register 13*a* is set so that the minute register 33 reaches 0 and triggers 5 minute register 34 right on the start of each five minute interval. While minute register 33 holds a 0, only the hour and 5 minute indications show on elements D1 through 12. The hour indication consists of a long flash occurring every 2 seconds. When minute register 33 holds a 1 or a 2, the element following the one indicating the 5 minute position flashes once or twice respectively in the time between successive hour flashes. When minute register 33 reaches the number 3, the 5 minute indication shifts to the next element while the previous one flashes twice to show 2 minutes before. The previous element flashes once when minute register 33 holds a 4. These minute indications for the different numbers in register 33 are shown in the last column of FIG. 5.

In addition to the apparatus for the aforementioned modifications, the embodiment of FIG. 2*c* uses apparatus for decoder 56*c* consisting of decoders 88 and 89 along with OR gates 90. This apparatus is similar to that of decoder 56*b* except that the outputs of gates 54 are applied to both decoders 88 and 89 and the comparable outputs of decoders 88 and 89 to OR gates 90 for the same numbers are offset from each other by one. For LEDs, decoder 89 can also receive the outputs of gates 55. If LCDs are used, another decoder will be necessary to handle the hour information from gates 55. The outputs from decoder 89 go to OR gates 90 to energize elements D1 through 12 corresponding to the number in 5 minute register 34. The outputs from decoder 88, however, are offset to OR gates 90 so that they energize elements D1 through 12 corresponding to the number in register 34 plus one.

Output B1 enables decoder 89 constantly when minute register 33 holds the numbers 0, 1, or 2, because of inputs from outputs A3 and A4. Similarly, output B2 holds decoder 88 enabled when register 33 holds the numbers 3 or 4, as a result of inputs from outputs A5 and A6. This action results in the energizing of the one of elements D1 through 12 corresponding to the number in register 34 while register 33 holds a 0, 1, or 2, and the energizing of the element corresponding to the next number while register 33 holds a 3 or 4.

Outputs B1 and B2 both receive inputs from outputs A7, A13, and A14, enabling the one of decoders 88 or 89 not already enabled, to thus produce the minute indications. When register 33 holds a 1, the resulting 1/16th of a second pulse from output A7 enables decoder 88 to flash the next element to indicate 1 minute past the 5 minute indication resulting from the output of decoder 89. When register 33 holds a 2, the two 1/16th of a second pulses resulting on the A14 output flash the next element twice to indicate two minutes past. When register 33 holds a 3, output A14 again produces two pulses but, since decoder 88 is now enabled while decoder 89 is not, the pulses effectively energize decoder 89 to flash the previous element twice to show 2 minutes before the 5 minute indication resulting from the output of decoder 88. When register 33 holds a 4, output A13 produces a pulse to again energize decoder 89 to flash the previous element to indicate 1 minute before.

Added flip flop 80 changes state with each cycle of the 1 hertz signal from frequency divider 12*a* to alternately enable the A1 output and the A7, A13, and A14 outputs. The A1 output thus produces the $\frac{1}{4}$ second negative pulse for the hour indication every 2 seconds; the pulses from the A7, A13, and A14 outputs for minute indications, when present, occur on the seconds in between the hour indications. The waveforms for the aforementioned outputs are shown in FIG. 3*c* along with the A3 through 6 outputs for the different numbers in register 33. FIG. 4*c* may be referred to along with FIG. 2*c* for the detailed inventory of the inputs to each of the outputs of ROMs 36 and 37, as modified.

FIG. 2*d* shows still another modification to ROMs 36 and 37 to produce still another type of indication of the minutes different from the 5 minute indication. In this embodiment, clockwise or counter clockwise rotations indicate minutes past or before respectively, and the number of rotations per second corresponds to the number of minutes. This way of indicating the minutes permits the hour indication to remain on continuously rather than flashing intermittently. The 5 minute indication has an added flicker to distinguish it easily from the hour indication. Each rotation results from energizing each of the elements D1 through 12 in turn starting with the one indicating the 5 minute position. In addition to providing minute indications not masked or interfered with by the hour indication, the rotations produce an attention-getting animation. Flip flop 45 and gates 52 for the alert indications will not be used.

In this embodiment, the A1 output controlling gates 55 for the hour indication receives the enabling input from time switch 44 and the 32 hertz signal for multiplexing decoders for LEDs. The A2 output receives the input from switch 44 and the inverted 32 hertz signal when LEDs are used. The A2 output controlling gates 54 for the 5 minute indication also receives an 8 hertz input which causes it to flicker at the 8 hertz rate. The A2 output may also receive an input from inverter 50, as indicated by the triangular dot, to save on the number of decoders required. The input from inverter 50 turns the 5 minute indication off during each of the rotations; its use is optional if the necessary number of decoders is present.

With LCDs, and with the input from inverter 50 to the A2 output omitted, it is necessary to have three decoders, one for each of the hour, 5 minute, and minute sets of information. The input from inverter 50 to the A2 input allows the minute and 5 minute information to share a decoder. If LEDs are used, the hour and minute information can share a decoder with the 32 hertz time multiplexing. Another decoder is necessary to handle the 5 minute information unless the input from inverter 50 is used to allow the minute and 5 minute information to time share the same phase 32 hertz signal. In the latter case, a single decoder can handle all three sets of information.

The time register 13*a* is set as for the FIG. 2*a* embodiment in which the time is before and after the 5 minute indication for different numbers in register 33, as shown in the third column of FIG. 5. As in the FIG. 2*a* embodiment, the one minute before and after positions of register 33 enable the A3 and A5 outputs while the 2 minutes before and after enable the A4 and A6 outputs. The A3 through A6 outputs, however, are all applied as inputs to the B2 output and the waveforms are different, as shown in FIG. 3*d*. The A3 and A5 outputs in combination produce $\frac{3}{8}$ths of a second negative pulses every second while the A4 and A6 outputs in combination produce two $\frac{3}{8}$ths of a second negative pulses every second as shown in FIG. 3*d*. The A13 output is enabled to apply the 32 hertz signal via the B1 output to step counter 49 during the $\frac{3}{8}$th second pulses from the B2 output. Counter 49 thus steps through one cycle of 12 for one rotation during each pulse.

The A7 output receives the same inputs as for the FIG. 2*a* embodiment and so controls counter 49 to run in the up direction when the number in register 33 is for minutes past and to run in the down direction for minutes before. The rotations resulting from the B2 output are clockwise for the minutes after and counter clockwise for the minutes before. The number of pulses per second, and so the number of rotations, corresponds to the number of minutes before or after in response to the A3 through A6 outputs.

AND gate 53 is inserted in the inverter 50 output to gates 53 to provide a covenient way to insert the 32 hertz inverted signal for decoder multiplexing for LEDs. It would not be needed for LCDs. As previously mentioned, the inverter 50 output turns off the 5 minute indication during the rotations if applied as an input to the A2 output by the connection indicated by the triangular dot. In addition to driving inverter 50, the B2 output alternately enables the A13 output and operates gates 48 which set counter 48 to the number held in register 34. The rotations thus always start from the 5 minute position. FIG. 4*d* may be referred to along with FIG. 2*d* for the detailed inputs to ROMs 36 and 37.

This embodiment could, of course, be further changed in several ways. The time scale could be extended by adding flip flop 80 as in the FIG. 2*c* embodiment. The starting point for the rotations could be made the 12 o'clock position instead of the five minute position by applying the B2 output to reset counter 49 instead of to operate gates 48. Further, the rotations could be limited to half rotations, clockwise and counter clockwise between the 12 and 6 o'clock positions by narrowing the pulses from outputs A3 through A6. The half rotations would still avoid any masking by the hour and 5 minute indications, would still provide animation, and would add a spacial indication to the clockwise and counter clockwise indications of after and before. The half rotations would take less time and allow for larger time gaps between the one or two each second, or would allow for four per second to indicate minutes after only.

The optical display 17*b* of FIG. 9 consists of only six optical display elements F2, F4, F6, F8, F10, and F12 located at the even hour positions on the watch, or clock, face. This embodiment shows the hour or 5 minute interval at an even numbered position by energizing the element at that position on display 17*b*. Two adjacent elements energized at the same time indicate the intermediate odd numbered position. The hour and 5 minute indications occur on alternate seconds to avoid possible masking or confusion of one indication by the other. The 5 minute indication flickers to distinguish if from the hour indication which is steady. Flashes on adjacent elements before or after the one or two indicating the 5 minute position indicate the minutes before or after, as in the FIG. 2*a* embodiment. Five second indications show even and odd positions as for hours and 5 minutes and blink the number of times a second corresponding to the number of seconds past the five second indication, as in FIG. 2*a*.

Some of the apparatus of FIG. 9 is the same or similar to the apparatus of FIG. 2*a*. Frequency divider 12*a* and time register 13*a* along with its registers 31 through 35 are the same. Signal selectors 21*b* includes gates 154 and 155 which are the same as gates 54 and 55 of signal selectors 21*a* of FIG. 2*a* except for the control input source. Signal selectors 21*b* further includes gates 158 to control the application of the contents of 5 second register 32 to display energizers 19*b*. Gates 158 are typically the same as gates 154 and 155 but have decoder 58 as their nearest corresponding functional component in FIG. 2*a*. Gates 148 and up/down counter 149 correspond to gates 48 and counter 49 of FIG. 2*a*; similarly, gates 153 correspond to gates 53. Signal selectors 20*b* consists only of gates 153. Inverters 41, 42, and 43 are the same as in FIG. 2*a*.

Display energizers 19*b* receives the binary inputs from gates 153, 154, 155, and 156 to energize the appropriate element or elements of display 17*b*. Display energizers 19*b* consists of two 1 of 6 decoders 156*a* and 156*b* which each receives the binary inputs, a set of six OR gates 160 which each receives an input from decoder 156*a* and an input from decoder 156*b*, and a set of six drivers 161 responding to the outputs of OR gates 160 to energize corresponding elements F2, F4, F6, F8, F10, and F12 of display 17*b*. Decoder 156*a* produces an output to energize one of the elements of display 17*b* whenever it receives the binary input for the corresponding even number or the following odd number. Decoder 156*b* responds to the binary inputs for even numbers and the preceding odd numbers. The decoder 156*a* and 156*b* outputs thus go to energize the same element of display 17*b* for even numbered inputs and the adjacent elements for odd numbered inputs.

Display energizers 19*b* thus respond to binary inputs for even numbers by energizing the corresponding element of display 17*b* and to binary inputs for odd numbers by energizing the elements of display 17*b* for both of the even numbers adjacent to the odd number. Only one of the elements of display 17*b* is energized at a time in response to inputs from counter 149 via gates 153, as will later be explained. The input operating gates 153 is therefore applied to disable decoder 156*b* to prevent a dual response to odd numbers. Drivers 161 will be of a type suitable for the kind of elements — LEDs or LCDs — used by display 17*b*.

Time switch 144 corresponds to time switch 44 of FIG. 2*a* in that it may be used to demand time readouts when operated by the user or be left on to produce continuous readouts. Instead of applying an enabling input directly to ROM 136, however, the operation of time switch 144 removes a reset drive through inverter 163 from flip flops 164 and 165 and enables AND gate 166. The next positive to negative transition on the 1 hertz output to AND gate 166 then toggles flip flop 164 from its reset position. Flip flop 164 in its other position applies a time readout enabling input to ROM 136, enables AND gate 167 so that succeeding transitions of the 1 hertz signal will toggle flip flop 165, and disables AND gate 166 so that flip flop 164 remains in position to enable the time readout. Operation of second switch 143 applies an input to ROM 136 to enable readout of the seconds and disables time switch 144 to interrupt any time readout in process while seconds are being read out. Flip flop 165, like flip flop 80 of FIG. 2*c*, alternates positions with each cycle of the 1 hertz signal. Flip flop 165 enables hour and minute readouts on alternate seconds.

Most of the functions of ROMs 136 and 137 are the same as, or similar to, the functions of ROMs 36 and 37 respectively of FIG. 2*a*. Outputs of ROMs 136 and 137 use the prefixes A*b* and B*b* respectively and, with the exception of outputs A*b*1 and A*b*13, have the same number designations as their counterparts of ROMs 36 and 37. Output A1 of ROM 36 operates gates 55 for hour readouts and gates 48 to set counter 49 to the 5 minute position. ROM 136 output A*b*13 operates gates 155 for hour readouts and output A*b*1 operates gates 148 to set counter 149 to the 5 minute position. Output A*b*1, like output A1, produces $\frac{1}{4}$ second pulses but only on every other second. Output A*b*13 produces one second pulses every other second.

Other outputs of ROMs 136 and 137 perform substantially the same functions as the similarly numbered outputs of ROMs 36 and 37. Those relating to hour and minute readouts, however, occur only on hour and minute positions respectively of flip flop 165, which changes from one position to the other each second. There are also other changes in the output waveforms which will be discussed with the output functions. The setting of time register 13*a* for this embodiment will be the same as that for the apparatus of FIG. 2*a* which is shown in the third column of FIG. 5.

Output A*b*2 operates gates 154 while flip flop 165 is in its minute position every other second to produce a readout of the 5 minute position as does output A2 by operating gates 55. Because output A*b*2 also receives the 8 hertz signal as an input, the five-minute indications produced appear to flicker at the 8 hertz rate and are easily distinguishable from the hour indications. Output A*b*2 is also shown receiving an input from the B2 output via inverter 150. This input disables the A*b*2 output while minute indications are being produced. The result is a sense of movement from the five minute indications to the minute indications.

Outputs A*b*3 and A*b*4, like the A3 and A4 outputs, respond to the contents of register 33 when the time indicated is 1 and 2 minutes respectively before or after the five minute position. The A*b*3 and A*b*4 output waveforms, shown in FIG. 10, are different from the A3 and A4 waveforms in that they occur only every other second and consist of bursts of two 32 hertz cycles rather than single 16 hertz cycles. The result is that the B1 output to which they are applied as inputs steps counter 149 twice for the A*b*3 output and four times for the A*b*4 output. This difference is necessary because advancing one element on display 17*b* requires an advance of two counts.

Outputs A*b*5 and A*b*6 are the same as outputs A5 and A6 except that they occur only every other second. The A*b*5 and A*b*6 outputs go as inputs to output B2 which drives inverter 150 to operate gates 153, to enable AND gates 170 and 171, and to disable output A*b*2. The operation of gates 153 applies the contents of counter 149 to decoders 156*a* and 156*b* after each pair of steps: as a result the next one or two elements of display 17*b* is energized to show one or two minutes before or after the 5 minute position. Enabling gates 170 and 171 allows the A*b*7 output to disable one or the other of decoders 156*a* or 156*b* for minutes before or after, as will later be described. The disabling of output A*b*2 to turn off the 5 minute indication during the minute indication has already been discussed.

The A*b*7 output, like the A7 output, responds to the number in register 33 which shows whether the time is before or after the 5 minute indication. Output A*b*7 goes to the up/down control input of counter 149 to determine the direction in which the counter counts and to AND gates 170 and 171 to disable the appropriate one of decoders 156*a* or 156*b*. The A*b*7 output is negative when the time is 1 or 2 minutes before the 5 minute indication and positive at other times. Counter 149 counts down when its up/down input is negative and up when the input is positive. AND gate 170 disables decoder 156*b* during the minute indications when the A*b*7 output is negative and AND gate 171 disables decoder 156*a* during the minute indications when the A*b*7 output is positive. Decoder 156*a* is thus used to show minutes before and decoder 156*b* to show minutes after. It will be recognized that either decoder could be used when 5 minute register 34 holds an even number; odd numbers, however, require that decoder 156*a* be used for before and decoder 156*b* for after to energize the next one or two elements for minute indications.

The A*b*8 output, like the A8 output, controls the readout of 5 second register 32. Whereas the A8 output operates decoder 58, the A*b*8 output operates gates 158 to apply the contents of register 32 to decoders 156*a* and 156*b*. Output A*b*8 is enabled only when second switch 143 is operated and the hour and minute readouts are disabled. The 5 second positions are then indicated in the same way as the hour and 5 minute positions except when the B*b*3 output is received as an input. The result of the B*b*3 output is that the 5 second indications are blinked a number of times each second corresponding to the number of seconds past the 5 second position, as will next be explained.

It will be recalled that the 5 second indications on elements E3, E6, E9, and E12 of display 17*a* of FIG. 2*a* are blinked the number of times each second corresponding to the number of seconds past the 5 second position as indicated by the contents of register 31. This blinking is controlled by the A9 through A12 outputs applied to the B3 output going to decoder 58. the A*b*9 through A*b*12 outputs are the same as the A9 through A12 outputs respectively and go as inputs to the B*b*3 output. The B*b*3 output goes back as an input to the A*b*8 output to produce the blinking by turning off gates 158 in response to the A*b*9 through A*b*12 outputs.

The blinking of the 5 second indications provides the necessary information to tell the time to the second but it is also somewhat difficult to read. The blinking may be omitted by omitting the input to the A*b*8 output from output B*b*3. The 1 hertz signal may be substituted as an input to output A*b*8 so that the 5 second indication appears for a $\frac{1}{2}$ second each second. The user may then watch for a 5 second change and keep track of the seconds after by counting the successive indications.

The embodiment of FIG. 9 has the advantage of using fewer optical elements to show the time. The user must wait long enough for both the hours and minutes to be presented before he can read the time. It is possible, however, that this presentation will occur as rapidly as he wishes to read the time, in any event. It will be recognized by those skilled in the art that various changes can be made to the apparatus of FIG. 9, similar to the changes made to the apparatus of FIG. 2*a* in FIGS. 2*b*, 2*c*, and 2*d*, to change the time scale and to show the minutes in different ways. Further, the system of showing the number of seconds from the 5 second position could be used to show the number of minutes from the 5 minute position. It would simply be a matter of substituting the outputs of register 31 for those of register 33 as inputs to the A*b*9 through A*b*12 outputs and applying the B*b*3 output as an input to the A*b*2 output.

The embodiment of FIG. 11*a* shows the time on an optical display 17*c* having only four elements located at the 3, 6, 9, and 12 o'clock positions. The user can select either an alternation of the hour and 5 minute positions or an alternation of the minute and 5 second positions for presentation on display 17*c*. The hour, 5 minute, and 5 second presentations use the same system as was used for the 5 second presentations in the apparatus of FIG. 2*a*. The number of minutes before and after the 5 minute position are indicated by the number of rotations counter clockwise and clockwise respectively. The rotations clearly distinguish the minute indications from the 5 second presentations and the 5 minute indication flickers to distinguish it from the hour indication.

As will be recalled, energizing the element at the 3, 6, 9, or 12 o'clock position indicates the respective position directly. The other eight positions are indicated by energizing the element closest to the desired position for an extended period and the element next closest for a very brief period. For example, the turning on of the element at 9 o'clock and a flash of the element at 3 o'clock and a flash of the element at 6 o'clock indicates the 4 o'clock position. The turned on element is blinked when the other is flashed to add a sort of animated arrow effect pointing from the turned on element in the direction of the position being indicated.

Much of the apparatus of FIG. 11*a* is the same or similar to that of the apparatus of FIGS. 2*a* and 9. Frequency divider 12*a* and time register 13*a* along with its registers 31 through 35 are the same. Signal selectors 21*c* with gates 254, 255, and 258 is substantially the same as signal selector 21*b* of FIG. 9 with gates 154, 155, and 158. Display energizers 19*c* and ROMs 236 and 237 are different and will be discussed in detail later. Inverters 41, 42, and 43 are the same as in FIGS. 2*a* and 9. Flip flops 264 and 265 along with AND gates 266 and 267 and inverter 263 are substantially the same as flip flops 164 and 165 along with AND gates 166 and 167 and inverter 163 of FIG. 9.

Minute-second switch 245 is similar to second switch 143 of FIG. 9 providing an enabling input to ROM 236 and a disabling hour-5 minute switch 244. Switch 245 also provides an input to OR gate 268 which then operates flip flops 264 and 265 as flip flips 164 and 165 are operated in response to switch 144 in the apparatus of FIG. 9. Switch 244 differs from switch 144 in that it provides a direct enabling input to ROM 236 and operates flip flops 264 and 265 through OR gate 268. Switch 244 can be operated to demand hour and 5 minute readouts for LEDs or be left on for LCDs. Switch 245 is to be operated whenever the user wants to know the number of minutes or 5 seconds and is wired to override switch 244. Operation of either switch 245 or 244 lets flip flop 264 go to its enabling position and flip flop 265 to change positions each second in response to the 1 hertz signal, as flip flip 165 did in the apparatus of FIG. 9.

Outputs A*c*1 through A*c*4, and A*c*18 of ROM 236, control the production of the 5 second, 5 minute and hour indications while the remaining outputs of ROM 236 and the outputs of ROM 237 control production of the minute and second indications. Output A*c*4 is enabled for both 5 minute and 5 second indications. Operation of switch 244 enables outputs A*c*2, A*c*3, and A*c*18 for the alternate hour and 5 minute indications. Flip flop 265 enables output A*c*3 to operate gates 255 when in its hour position and enables output A*c*2 to operate gates 254 when in its 5 minute position. As previously mentioned, flip flop 265 alternates position each second in response to the 1 hertz signal so gates 255 and gates 254 operate during alternate seconds. Gates 255 apply the contents of hour register 35 to display energizers 19*c* and gates 254 apply the contents of 5 minute register 34.

The 1 of 12 decoder 256 of display energizers 19*c* receives the contents of registers 35 and 34 in turn from gates 255 and 254 respectively and produces an output according to the number being received. The outputs for the numbers 3, 6, 9, and 12 go only to one of OR gates 270 while those for the remaining numbers go to one of OR gates 270 and one of AND gates 271. (OR gates 270 and AND gates 271, along with AND gates 272, OR gates 260, and drivers 261, are all part of display energizers 19*c*.) Each OR gate 270 receives the outputs of decoder 256 for one of the numbers 3, 6, 9, or 12 and for the two adjacent numbers. The outputs from OR gates 270 each go through an associated AND gate 272 and an OR gate 260 in turn to an associated driver 261.

The outputs from decoder 256 for the three numbers 2, 3, and 4, for example, pass through the same OR gate 270, through the associated AND gate 272 when it is enabled, and through the associated OR gate 260 to the associated driver 261 which then energizes element G3. The outputs for the numbers 2 and 4 also pass through their associated AND gates 271, when enabled, to OR gates 260 and drivers 261 for the elements G12 and G6 respectively. The A*c*4 output from ROM 236 enables AND gates 271 for a $\frac{1}{8}$th second interval that starts at the middle of each second. The A*c*18 output from ROM 236 disables AND gates 272 for the same $\frac{1}{8}$th second interval. The result is that any of the three numbers 2, 3, and 4 energize the G3 element during the second except for the $\frac{1}{8}$th second interval when AND gates 272 are disabled. The number 2 also energizes the element G12 and the number 4 the element G6 during the $\frac{1}{8}$th second interval when AND gates 271 are enabled.

Operation of switch 245 enables output A*c*1 and outputs A*c*5 through 17 for production of the second and minute indications. Output A*c*1 operates gates 258 to apply the contents of 5 second register 32 to decoder 256 for the energizing of elements to show the 5 second position in the same way that the 5 minute and hour positions were shown. (Except that gates 272 will not be disabled by the A*c*18 output.)

The A*c*5 output goes negative for $\frac{1}{2}$ second when switch 245 is in the minute position and minute register 33 holds the numbers for the 1 minute before and 1 minute after the 5 minute position. Output A*c*6 goes negative for one second. When switch 245 is in its minute position and minute register 33 holds the numbers for 2 minutes before and after the 5 minute position. The numbers of minutes before and after the 5 minute position that correspond to the coded contents of minute register 33 are shown in the third column of FIG. 5. Output lines A*c*5, A*c*6, and A*c*7 are enabled when the same conditions exist in minute register 33 that enabled output lines A5, A6, and A7 of FIG. 2*a* respectively.

ROM 236 output line A*c*5 and A*c*6 will activate ROM 237 output line B*c*5 which is fed back to ROM 236 to enable output lines A*c*8 through A*c*13. Outputs A*c*8 through A*c*13 produce the energizing of elements G12, G3, G6, and G9 in a rotational manner for an indication of 1 or 2 minutes before or after the 5 minute position. The $\frac{1}{2}$ second enabling from an A*c*5 output results in one rotation while the full second enabling from an A*c*6 output results in two rotations. ROM 236 output line A*c*7 will activate ROM 237 output line B*c*6. Both the B*c*6 output and its logical inversion from inverter 275 are fed back to ROM 236 to control the enabling and disabling of output lines A*c*9 and A*c*11 or A*c*12 and A*c*13. Output lines A*c*11, A*c*10, A*c*9, and A*c*8 will activate output lines B*c*1 through 4 respectively. Output lines B*c*1 and B*c*3 will also be activated by output lines A*c*13 and A*c*12 respectively. Outputs B*c*1 through 4 go to OR gates 260 to energize elements G3, G6, G9, and G12 respectively. When the contents of minute register 33 correspond to 1 or 2 minutes before the 5 minute position as indicated by the numbers −1 and −2 in the third column of FIG. 5, the A*c*7 output of ROM 236 will enable output lines A*c*9 and A*c*11 while it disables output lines A*c*12 and A*c*13. Output lines B*c*1 through B*c*4 will then energize elements G12, G9, G6, and G3 according to the timing pattern of outputs A*c*8 through 11 as illustrated in FIG. 12. This produces a counter clockwise rotational effect. When the contents of minute register 33 correspond to 1 or 2 minutes after the 5 minute position as indicated by the numbers +1 and +2 in the third column of FIG. 5, the A*c*7 output of ROM 236 will disable output lines A*c*9 and A*c*11 while it enables output lines A*c*12 and A*c*13. Output lines B*c*1 through B*c*4 will then energize elements G12, G3, G6, and G9 according to the timing pattern of outputs A*c*8, A*c*13, A*c*10, and A*c*12 as illustrated in FIG. 12. This produces a clockwise rotational effect.

Output lines A*c*14 through A*c*17 produce outputs similar to those of output lines A9 through 12 of FIG. 2*a*. The output waveforms are the same except that the pulses from output lines A*c*14 through 17 occur only if switch 245 is in its seconds position. An output from any of output lines A*c*14 through 17 will activate output line B*c*7. The B*c*7 output is inverted by inverter 276 and then fed back to ROM 236 thus disabling output line A*c*1 each second in order to blink the 5 second display the number of times corresponding to the number of seconds past the 5 second position. This is the same action as for the seconds display in FIG. 2*a* except that the blinking is effected by disabling gates 258 rather than decoder 58.

The modification to ROM 236 shown in FIG. 11*b* produces a different type of indication of the number of minutes past the 5 minute position. Output lines A*c*8 through A*c*11 receive different inputs and activate output lines B*c*1 through 4 respectively instead of the reversed order used in FIG. 11*a*. Output lines A*c*12 and A*c*13 are not used. When the coded contents of minute register 33 correspond to the numbers 1 through 4 as shown in column four of FIG. 5, then output lines A*c*8 through 11 are enabled respectively. Output line B*c*1 will energize element G3 when activated by the A*c*8 output to show 1 minute past the 5 minute position. Output lines B*c*2 through 4 similarly energize elements G6, G9, and G12 respectively to show 2, 3, and 4 minutes past respectively. All of these indications flicker due to the presence of the 8 hertz signal as an input for output lines A*c*8 through A*c*11. This flickering distinguishes the minute indications from the 5 second indications with which the minute indications are alternating.

The apparatus of FIG. 13 shows a modification which can be used for an electric clock. Timing signal source 11*b* is the 60 hertz power line frequency common in the United States and generally used for electric clocks having synchronous motor drives. In the present case, timing signal source 11*b* will further include suitable circuits to limit the power line voltage and produce a substantially square wave output to toggle frequency divider 12*c*.

Frequency divider 12*c*consists of a conventional divide by two stage which can be located on ship. Frequency divider 12*b* performs the same functions as frequency divider 12*a* and is the same except that it divides by 30 rather than by 32. The difference in using frequency divider 12*b* rather than frequency divider 12*a* in the various embodiments is a small shift in the timing which will not appreciably affect operation. The difference is that the last 1/16th of the waveforms for each second are chopped off and the remaining 15/16th are stretched in time to fill the full second.

All of the previously described embodiments can thus be used in an electronic clock by substituting the modifications of FIG. 13. In most cases, changes will also be made to use higher powered optical display elements and the drivers necessary to suitably energize them. Clock faces have room to combine several displays, such as the 12 and 4 element displays of FIG. 2*a*. With power not being an important consideration, greater use could also be made of animation.

Those skilled in the art will recognize that many other changes and variations could be made and that the features of the several embodiments can be combined in various model designs without departing from the spirit and scope of the invention. The minute and second display of FIG. 11*a* can, for example, be combined with any of the 12 element displays for hours and 5 minutes of FIGS. 2*a* through *d* or the six element display of FIG. 9.

What is claimed is:

1. In an electronic time keeping device having a timing signal source and a time register holding the time in electrical form, the combination of:

(a) a plurality of optical display elements located at the traditionally numbered hour and 5 minute positions on the face of said time keeping device;

(b) means responsive to digital signals identifying said positions for energizing those of said optical display elements at said positions, said energizing means receiving said digital signals from applying means;

(c) first means coupled to said time register for applying one of said digital signals identifying the hour position in said time register to said energizing means;

(d) second means coupled to said time register for applying one of said digital signals identifying the 5 minute position held in said time register to said energizing means;

(e) means coupled to said timing signal source for operating said first and second applying means in different distinguishable time patterns recurring repetitively a plurality of times per minute;

(f) means coupled to said time register and to said timing signal source for generating a sequence of said digital signals repetitively a plurality of times per minute, said generating means being responsive to the number of minutes from the 5 minute position held in said time register and said digital signals in said sequence each identifying a different one of the positions of said elements; and (g) third means coupled to said generating means for applying said sequences of said digital signals from said generating means to said energizing means.

2. The combination according to claim 1 wherein the number of said digital signals in each of said sequences from said generating means corresponds to the number of minutes that the time in said time register is different from the 5 minute position.

3. The combination according to claim 1 wherein said digital signals in said sequential series from said generating means identify positions successively changing in a counter clockwise direction to indicate the time in minutes before the 5 minute position in said time register and in a clockwise direction to indicate the time in minutes after the five minute position in said time register.

4. The combination according to claim 1 wherein the number of said optical display elements is 12.

5. The combination according to claim 1 wherein the number of said optical display elements is less than 12 and sid energizing means responds to said digital signals for positions intermediate to those at which said optical display elements are located by energizing more than one of said optical display elements adjacent to said intermediate position.

6. The combination according to claim 1 wherein said generating means includes a counter coupled to said third applying means; means coupled to said timing signal source and said time register for periodically stepping said counter responsive to the minute position held in said time register; and wherein said digital signals from said third applying means to said energizing means are produced by said counter.

7. The combination according to claim 6 wherein said counter is an up and down counter and said generating means includes means coupled to said time register for controlling said counter to step up or down depending on the minute position in said time register.

8. The combination according to claim 6 including means coupled to said counter and said time register for setting said counter according to the 5 minute position in said time register before each periodic operation of said stepping means.

9. The combination according to claim 1 wherein said generating means is also responsive to the 5 minute position in said time register for the position identified by the first said digital signal in each of said sequences.

10. The combination according to claim 9 wherein said sequences each start with the one of said digital signal identifying the one of said elements adjacent to the one of said elements showing the 5 minute position and the number of said digital signals in each of said sequences corresponds to the number of minutes from the 5 minute position held in said time register.

11. The combination according to claim 10 wherein said digital signals in each of said sequences identify ones of said elements at successive locations from the one showing the 5 minute position.

12. In an electronic time keeping device having a time signal source and a time register holding the time in electrical form, the combination of:

(a) a plurality of optical display elements located around a loop on the face of said time keeping device;

(b) means coupled to said elements for energizing said elements responsive to signals identifying those of said elements to be energized;

(c) first means coupled to said timing signal source and to said time register for applying to said energizing means signals identifying those of said elements at the hour and 5 minute positions held in said time register; and (d) second means coupled to said timing signal source and to said time register for applying a sequence of signals repetitively a plurality of times per minute to said energizing means, said sequence of signals identifying a number of said elements corresponding to the number of minutes from the 5 minute position held in said time register.

13. The combination according to claim 12 wherein the one of said elements energized in response to the first signal in each sequence is adjacent to the one of said elements showing the 5 minute position.

* * * * *

UNITED STATES PATENT OFFICE

CERTIFICATE OF CORRECTION

Patent No. 4,106,281 Dated August 15, 1978

Inventor(s) Alfred B. Freeman

It is certified that error appears in the above-identified patent and that said Letters Patent are hereby corrected as shown below:

Column 2, line 49, cancel "a".
Column 5, line 53, "is" should read --it--.
Column 6, line 21, cancel "1".
line 33, cancel "and" first occurrence.
Column 8, line 32, "and" should read --are--.
Column 15, line 36, "if" should read --it--.
Column 18, line 15, "the Ab9 should read --The Ab9--.
Claim 5, line 3, "sid" should read --said--.
Column 24,line 1, Claim 12, line 1, "a time" should read --a timing--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*